US009643685B2

(12) United States Patent
Wolz et al.

(10) Patent No.: US 9,643,685 B2
(45) Date of Patent: May 9, 2017

(54) METHOD FOR MOUNTING A PREFABRICATED DECK

(71) Applicant: WOLZ NAUTIC GMBH & CO. KG, Gauk•nigshofen (DE)

(72) Inventors: Andreas Wolz, Würzburg (DE); Michael Wolz, Gaukonigshofen (DE)

(73) Assignee: WOLZ NAUTIC GMBH & CO. KG, Gaukönigshofen (DE)

( * ) Notice: Subject to any disclaimer, the term of this patent is extended or adjusted under 35 U.S.C. 154(b) by 0 days.

(21) Appl. No.: 14/761,679

(22) PCT Filed: Jan. 21, 2014

(86) PCT No.: PCT/EP2014/051105
§ 371 (c)(1),
(2) Date: Nov. 5, 2015

(87) PCT Pub. No.: WO2014/111592
PCT Pub. Date: Jul. 24, 2014

(65) Prior Publication Data

US 2016/0107725 A1 Apr. 21, 2016

(30) Foreign Application Priority Data

Jan. 21, 2013 (DE) ..... 10 2013 200 863

(51) Int. Cl.
*B63B 5/10* (2006.01)
*B63B 3/48* (2006.01)

(52) U.S. Cl.
CPC . *B63B 5/10* (2013.01); *B63B 3/48* (2013.01)

(58) Field of Classification Search
CPC ..... B63B 5/10; B63B 3/48
(Continued)

(56) References Cited

U.S. PATENT DOCUMENTS 2,744,043 A * 5/1956 Ramberg ..... B29C 53/602 156/155
6,367,399 B1 * 4/2002 Khachaturian ..... B63B 9/065 114/61.1

(Continued)

FOREIGN PATENT DOCUMENTS

CN 201472616 U 5/2010
DE 690 13 606 T2 3/1995

(Continued)

OTHER PUBLICATIONS

PCT International Search Report, PCT/EP2014/051105, May 12, 2014, 6 pages.

(Continued)

*Primary Examiner* — Lars A Olson
*Assistant Examiner* — Jovon Hayes
(74) *Attorney, Agent, or Firm* — Quarles & Brady LLP

(57) ABSTRACT

The invention relates to a method for mounting a prefabricated deck (31) on a boat deck (36), said prefabricated deck comprising one or more deck elements (02) and the method comprising the following steps: setting a target height profile (11) for the upper face of the prefabricated deck (01); generating a mounting height profile (22), which is spaced apart from, in particular spatially parallel to, the target height profile (11) in the direction of the boat deck (36) by the thickness of the deck element (02); measuring the upper face of the boat deck (36) as the actual height profile (21); determining the height difference (23) between the actual height profile (21) and the mounting height profile (22); producing at least one leveling means (38) per deck element (02), said leveling means having a material thickness that corresponds to the height difference (23); mounting, in particular gluing, the leveling means (38) and the deck element (02) to the boat deck (36), the surface of the
(Continued)

mounted prefabricated deck (31) substantially corresponding to the target height profile (11).

16 Claims, 3 Drawing Sheets

(58) Field of Classification Search
USPC ..... 114/85
See application file for complete search history.

(56) References Cited

U.S. PATENT DOCUMENTS

2008/0121160 A1* 5/2008 Ayras ..... B63B 29/025 114/71
2010/0024352 A1* 2/2010 Pope ..... E04B 1/3431 52/745.02
2011/0023763 A1* 2/2011 Morgan ..... C08G 59/50 114/85
2012/0234840 A1* 9/2012 Strassburger ..... F17C 1/04 220/590
2016/0107725 A1* 4/2016 Wolz ..... B63B 5/10 114/85

FOREIGN PATENT DOCUMENTS

DE 10 2010 043645 A1 5/2012
WO 2005115828 A1 12/2005

OTHER PUBLICATIONS

PCT English Language Translation of the International Preliminary Report on Patentability, PCT/EP2014/051105, Jul. 30, 2015, 8 pages.
International Search Report under date of mailing of Feb. 10, 2014 in connection with PCT/EP2013/069546.

* cited by examiner

METHOD FOR MOUNTING A PREFABRICATED DECK

CROSS-REFERENCE TO RELATED APPLICATIONS

This application represents the national stage entry of PCT International Application No. PCT/EP2014/051105 filed Jan. 21, 2014, which claims priority of German Patent Application No. 10 2013 200 863.5, filed Jan. 21, 2013, the disclosures of which are incorporated by reference here in their entirety for all purposes.

The invention relates to a method for preparing a boat deck for subsequent mounting of a prefabricated deck, to the mounting of a prefabricated deck and to a leveling means and a prefabricated deck according to the preambles of the independent claims. A leveling layer is produced for adjustment to the initially not exactly even boat deck so as to be able to subsequently mount the prefabricated deck on the boat deck.

Mounting of a prefabricated deck usually requires an even contact surface for the prefabricated deck. If a directed water drain is required, a curved surface or the like may also be required in deviation therefrom. At the least, a defined height profile is necessary for mounting the prefabricated deck. In the state of the art, a usually generous amount of filling compound is spread across large parts of the boat deck for this purpose. Said filling compound is then manually spread and leveled while constantly monitoring the achieved height profile so that the desired height profile is ultimately reached.

However, already the production of a plane surface causes significant difficulties especially in case of larger dimensions. Implementation becomes substantially more complicated if a directed water drain, in particular including curved surfaces, becomes necessary. In that case, monitoring the achieved surface in comparison with the desired target profile is extremely difficult. In the state of the art, this leads to the particular disadvantage that significant work is necessary to produce the corresponding mounting surface for mounting the prefabricated deck. Furthermore, the continuous application of the filling compound while comparing the surface to the desired target profile sometimes leads to an unnecessarily thick layer of filling compound on the boat deck and thus to an undesirably high weight.

Therefore, the object of the present invention is to produce a mounting surface above the boat deck to be covered with the prefabricated deck, which in this case exhibits increased precision in correspondence to the desired height profile and can be produced at lower cost.

The present object is attained by a method according to the invention of claim 1. A leveling means according to the invention for producing the required surface and a prefabricated deck according to the invention are specified in the independent device claims.

Advantageous embodiments of the invention are the subject-matter of the dependent claims.

The method according to the invention serves to prepare a boat deck for subsequent mounting of a prefabricated deck and to mount a prefabricated deck on a boat deck. In this context, the boat deck initially has a surface that is unsuitable for direct mounting of a conventional prefabricated deck because of the existing height profile. This is in particular because the boat deck usually has a slightly rippled surface that deviates from CAD models. By way of the generic method, a leveling layer is produced, which compensates the difference in shape between the existing surface of the boat deck and the required contour.

For implementation, two different variants of the method according to the invention can be used, which depend on whether the leveling layer is associated with the boat deck or with the prefabricated deck.

To realize a method according to the invention, first, a target height profile for the upper face of the prefabricated deck is set. During construction of a boat, the surface of a boat deck covered with a prefabricated deck is usually set. The criteria used for setting the resulting target height profile are initially immaterial. At the least, the knowledge of the upper face of the prefabricated deck forms the basis for subsequent calculation.

Starting from the set or determined target height profile, the spaced-apart mounting height profile necessary for the method according to the invention is now generated in the direction of the boat deck. The prefabricated deck comprises one or more deck elements. Said deck element can have the structure of a commonly known component to be placed on a boat deck, and hence, no further explanation is required in this regard for the time being. At the least, said deck element has a known thickness, which can vary across the size of the deck element. Starting from the target height profile, the mounting height profile is now determined, which is spaced apart by the thickness of the deck element.

In the simplest case, the mounting height profile is a plane surface oriented horizontally in terms of space. However, if a directed water drain is required and/or if the prefabricated deck has an uneven contour at the bottom face, it may also be necessary to configure the target height profile so as to have a contour, such as a curved shape, or also the mounting height profile can be configured so as to have a contour, such as a curved shape. With regard to the mounting height profile, at least a mapping of the surface that will form the bottom face of the deck element after placement of the prefabricated deck at the termination of the method according to the invention is required. In comparison to a classic way of mounting a prefabricated deck, the mounting height profile essentially corresponds to the upper face of the applied filling compound.

Furthermore, measuring of the actual height profile of the boat deck is required. Since usually, independently of the use of CAD systems, the surface of the real boat deck will not exactly correspond to available CAD data, corresponding measuring of the actual height profile is necessary. In this regard it is immaterial, however, whether the entire surface of the boat deck is measured as a whole or whether, in the alternative, only exemplary points are measured. Since no peaks are to be expected in the surface of the boat deck, it may usually be assumed that measuring, such as in a raster, is sufficient and extrapolation to the entire surface is possible.

Now, a height difference between the actual height profile and the mounting height profile must be determined. The resulting height difference will be a value that varies across the size of the boat deck.

As a substantial step in the method according to the invention, at least one leveling means per deck element is produced to compensate the existing surface of the boat deck and the desired surface of the prefabricated deck. Said leveling means has a thickness that corresponds to the previously calculated height difference. The manner in which the leveling means is produced is initially immaterial.

In the last step, the leveling means and the deck element are mounted, in particular by gluing, on the boat deck.

Afterward, the surface of the mounted prefabricated deck corresponds to the desired target height profile.

In both newly created methods, significant advantages are achieved over the state of the art. First of all, the previously enormous amount of work in applying the filling compound and the time required for mounting can be reduced significantly in comparison to the state of the art. As a result, significantly lower overall costs for placement of the prefabricated deck can be achieved. By way of the method according to the invention, in particular the quality of the mounting surface, i.e. the correspondence to the desired mounting height profile, can be enhanced. In particular, it will also be possible in many cases to reduce the total weight of the leveling means in contrast to the filling compound used otherwise for compensation.

According to a first variant of the method, the leveling means can be produced independently of the deck element. Once processed, the processed leveling means can then either be fixed to the deck element so as to produce a prefabricated deck with an integrated leveling layer, or alternatively, the processed leveling means can be transported to the construction site of the boat separately from the deck element. In this case, the leveling means is first fixed, in particular glued, to the upper face of the boat deck. Subsequently, the deck element is fixed, in particular glued, to the upper face of the leveling means.

Alternatively to the separate production of the leveling means with subsequent application on the bottom face of the deck element, the leveling means having a thickness corresponding to the height difference can optionally also be produced directly on the deck element. In this case, a plane source material having a usually constant material thickness is first applied to the bottom face of the deck element. Now, the bottom face of the applied source material can be directly processed, forming the leveling means already applied to the deck element. As a result, the prefabricated deck element comprising the bottom-face leveling means is simultaneously formed in the process. Inaccuracies due to an undesired shifting of the relative position between the deck element and the leveling means are precluded in this variant of the method because the leveling means is already firmly connected to the deck element during the integration of the height difference. Thus, it is obvious that the leveling means does not necessarily have to be produced first and be subsequently applied to the deck element. Instead, it is also possible to apply said leveling means to the deck element first and to subsequently finish the leveling means.

Once the prefabricated deck provided with the leveling layer has been produced, the prefabricated deck can be mounted on the boat deck by gluing. Although alternative approaches can be considered for mounting the prefabricated deck, the method of gluing, which is common in the state of the art, is to be assumed as a rule.

It is also possible to use both of the afore-described variants for covering a boat deck. Thus, an area of the boat deck can be covered with one or more prefabricated deck elements comprising an integrated leveling means on the basically bare boat deck, whereas in another area, the boat deck has a leveling layer as described above, to which one or more deck elements are applied.

The manner in which the mounting height profile is determined is initially immaterial. As a rule, it is to be assumed that the mounting height profile is determined with the aid of CAD models of the prefabricated deck and/or by suitable measurements on the boat deck using a laser scanner, for example.

Depending on the regular thickness of a glue layer for fixing the prefabricated deck to the boat deck, said glue layer may also be taken into account. Thus, the mounting height profile needed to implement the method according to the invention can be generated based on the knowledge about the desired upper face of the prefabricated deck and on the knowledge about the thickness of the prefabricated deck and, if necessary, taking into account the thickness of the glue layer.

It is advantageous if the thickness of the glue layer can be taken into account. This applies both to gluing the leveling means to the deck element and to gluing the prefabricated deck element comprising leveling means to the boat deck without leveling means.

In the simplest case, it is to be assumed that the prefabricated deck or the deck element and the glue layer have a constant thickness and that the mounting height profile consequently represents a spatially parallel surface, i.e. an offset surface, with respect to the target height profile. In this way, it is achieved that once the prefabricated deck has been mounted, the surface of the mounted prefabricated deck substantially corresponds to the target height profile.

By way of this advantageous embodiment, it becomes possible in particular to integrate the prefabricated deck to be used in the preparation of the boat deck, wherein, additionally, a material thickness of the prefabricated deck that varies across the extension can be taken into account.

It is particularly advantageous if the target height profile is set based on a desired water drain. As a rule, it is to be assumed that water entry is to be expected on the mounted prefabricated deck on the boat. Accordingly, the water has to be drained in a targeted manner. Hence, the desired water drain must be set, based on which the target height profile can be set in turn.

It is further particularly advantageous if a minimum material thickness is set for the leveling means. Depending on the production options and properties of the material used for the leveling means, in particular at edge portions of the leveling means, said material thickness may be zero when applied to the deck element in the extreme case. This means that the leveling means can be produced in such a manner that it can taper to zero. When applying the leveling means to the boat deck, it is advantageous to select a minimum material thickness of 5 mm so as to be able to ensure producibility and manageability. Corresponding to the set minimum material thickness—as a function of the properties of the leveling means—the mounting height profile is to be positioned at the smallest possible distance above the actual height profile in an advantageous embodiment. Consequently, the smallest distance between the mounting height profile and the actual height profile is identical to the minimum material thickness, and in the best case it is zero.

The manner in which the height difference between the mounting height profile and the actual height profile is determined is initially immaterial in this case. In a particularly advantageous manner, however, CAD systems are used for this purpose, corresponding CAD models of the mounting height profile and of the actual height profile being employed. These two height profile models can be correspondingly positioned relative to each other in the CAD system.

If the actual height profile of the entire surface of the boat deck is known, it is particularly advantageous if the resulting weight and/or the maximum material thickness of the leveling means are determined. To this end, the volume enclosed between the actual height profile and the mounting height profile can be used as a basis, and the maximum distance can be advantageously determined by means of a CAD system.

By this predetermination of the volume and the resulting weight and/or the maximum material thickness, a significant advantage is achieved over the state of the art. While it is required in the state of the art to merely estimate the resulting weight of the compensation mass, the weight of the leveling means can be determined in advance by way of the method according to the invention in an advantageous embodiment. Furthermore, said predetermination allows improved calculation of the costs to be expected and thus an improvement with regard to obtaining quotations and the like. Furthermore, the required source material can be selected in a cost-minimizing manner if the volume and/or the maximum thickness of the leveling means are known.

Although a desired water drain is usually sought in the state of the art as well, it still cannot be realized in many cases. This is in particular because during the application of the compensation mass, it cannot be assessed yet in the state of the art whether the desired water drain can be realized. In contrast, owing to the method according to the invention, this is possible in a particularly simple manner already when considering the determined mounting height profile with the measured actual height profile.

In this context, it is particularly advantageous that the target height profile is reset in a different way including a different water drain if an inappropriately high weight of the calculated leveling means and/or an inappropriately large distance between the actual height profile and the mounting height profile in an edge portion of the prefabricated deck and/or an inappropriately large maximum material thickness is determined. Owing to the advantageously available knowledge of the embodiment of the leveling means, a correction can be made even prior to its production, changing the target height profile so as to reduce the weight of the leveling means, or toward using a thinner source material. Also, it may be necessary to change the target height profile if an inappropriate distance occurs between the actual height profile and the mounting height profile in the edge portion. This may be problematic in particular if transitions to adjacent areas are to be realized. This applies to the area of stairs present or the like, for example.

The material from which the leveling means is produced is initially immaterial as long as it is ensured that the leveling means can be correspondingly used as a base for a prefabricated deck and is accessible to a production according to the method. In this regard, the embodiment of the leveling means made of a plastic material and/or plant materials is particularly suitable for realizing a lowest possible weight. When using plant materials, the use of cork is particularly suitable because it provides advantageous producibility, low weight and in particular a resistance against humidity. Thus, cork is particularly suited to be used as a leveling means.

The leveling means is to be designed in the size of the prefabricated deck or, if individual prefabricated deck elements having an applied leveling means are used, in the size of the individual deck elements. It is also possible to assemble the required size of the leveling means itself from individual components, although a complete single component is to be preferred.

In a particularly preferred variant, a plate is initially used for producing the leveling means, wherein said plate can have a substantially constant material thickness. To realize the varying material thickness, the plate is machined on at least one side. Based on the flexibility to be expected if advantageous materials are used and based on the usually merely rippled surface of the boat deck and often plane upper mounting surface, machining of the second side of the plate is usually unnecessary. For processing, the plate can be sucked to an even surface by means of a vacuum, for example, and then the upper face can be correspondingly processed, achieving the defined material thickness across the size of the leveling means at the height of the height difference.

By employing a considerable amount of tooling at significantly reduced processing time, it is also possible to apply the plate to an uneven base. In this case, the base has the kind of contour that results when adding the known height difference to an even surface. Thus, planar processing of the upper side of the plate becomes possible in case of a placed plate. This can be realized because only slight ripple-shaped fluctuations are to be expected with the unevenness of the actual height profile and also because the mounting height profile usually does not exhibit any peaks. Thus, it is conceivable, for example, to use a deformable steel plate, which is adjusted by means of a plurality of actuators toward a corresponding contour. In this way, a quick, because now planar, processing of the one side of the plate is made possible.

If production from a plastic material takes place and an extrusion process is used, for example, the plate can also be produced in such a way that the material thickness is continuously adapted to the required material thickness of the leveling means during the extrusion process of the plate, and machining can thus become unnecessary altogether.

In a particularly advantageous manner, i.e. in the normal case, the leveling means is glued on. In the implementation of the method according to the invention for gluing the leveling means to the deck element, this leads either to the formation of the prefabricated deck having an integrated leveling means or to the separate production of the deck element and of the leveling means, which are successively glued to the boat deck. To this end, it is particularly advantageous if the leveling means has a plurality of openings for venting. Said openings can be introduced into the leveling means, or a plate that already has a plurality of openings can be used as the source material. Thus, quick venting during gluing is achieved below the leveling means and distribution of the glue for gluing the leveling means is ensured.

In addition to the method according to the invention, a novel leveling means according to the invention for use as an intermediate layer when mounting a prefabricated deck on a boat deck is provided. In this context, the prefabricated deck comprises one or more deck elements, the bottom face of the deck element substantially defining a mounting height profile and the upper face of the boat deck substantially defining an actual height profile. The leveling means is to be designed to have at least the size of one deck element, which also includes that a leveling means is assembled from multiple pieces. The leveling means generically has a material thickness that corresponds to the height difference between the actual height profile and the mounting height profile, the leveling means corresponding to a filling compound in the state of the art.

According to the invention, the leveling means is produced so as to have a material thickness that substantially corresponds to the height difference prior to application on the boat deck. This means that the leveling means is produced independently of the actual boat deck.

In this context, a production and embodiment according to any one of the afore-described advantageous methods according to the invention is particularly advantageous.

Furthermore, a prefabricated deck according to the invention is provided, which has one or more prefabricated deck elements for covering a boat deck. Each prefabricated deck element in turn comprises a one-piece or multi-part deck covering, which is visible and walkable on the boat deck after mounting. Usually, this is a wood planking alternating with expansion joints. Stability is realized by means of a support plate lying directly or indirectly below the deck covering. Said support plate is substantially realized in the size of the prefabricated deck element.

According to the invention, however, the prefabricated deck element now has a leveling means according to the previous description at the bottom face. In contrast to the state of the art, the prefabricated deck element thus is suitable for directly covering a boat deck without prior application of a filling compound on the boat deck.

In the following figures, the method according to the invention is explained with the aid of examples.

In the figures:

FIG. 2 shows a novel prefabricated deck having an integrated leveling layer toward a boat deck without a compensation layer or the like.

Figure 1:
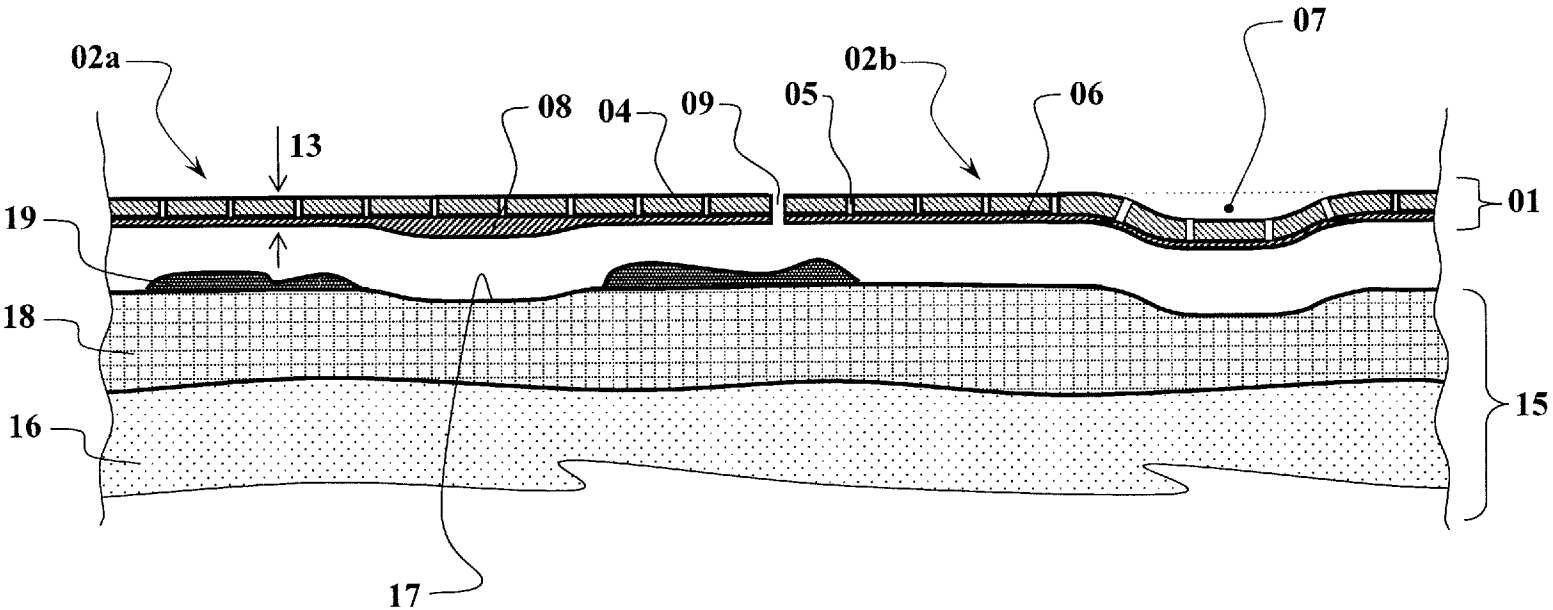
FIG. 1 shows a first embodiment example of a prefabricated deck in a commonly known design together with a newly created boat deck having a leveling layer.

FIG. 1 is a sketch of a first embodiment example for implementation according to the method in accordance with the invention, in which a prefabricated deck 01 is illustrated at the upper side. Independently of the illustrated exemplary embodiment of the prefabricated deck 01, comprising a recess 07 for an exemplary water drain and a stiffening 08 for increasing impact resistance, the prefabricated deck 01 comprises two deck elements 02*a* and 02*b*. To this point, this corresponds to the embodiments known from the state of the art including a regular prefabricated deck for covering any kind of boat deck. The deck elements 02*a* can be realized as having a plurality of wooden bars as a deck covering 04 that alternate with expansion joints 05 and having a support plate 06 lying underneath. Among other things, the resulting material thickness 13 of the deck elements 02 is relevant for consideration in this context.

Furthermore, the prepared boat deck 15 having a leveling means 18 is visible below. The prefabricated deck 01 can be glued to the correspondingly prepared boat deck 15 by applying an adhesive 19 in a commonly known manner. The leveling means 18 is applied to compensate for any unevenness of the real boat deck 16. The novel leveling means 18 corresponds to a filling compound commonly present in the state of the art. It is substantial that an upper mounting surface 17 on the leveling means 18, i.e. on the prepared boat deck 15, corresponds to the bottom face of the prefabricated deck 01.

Figure 2:
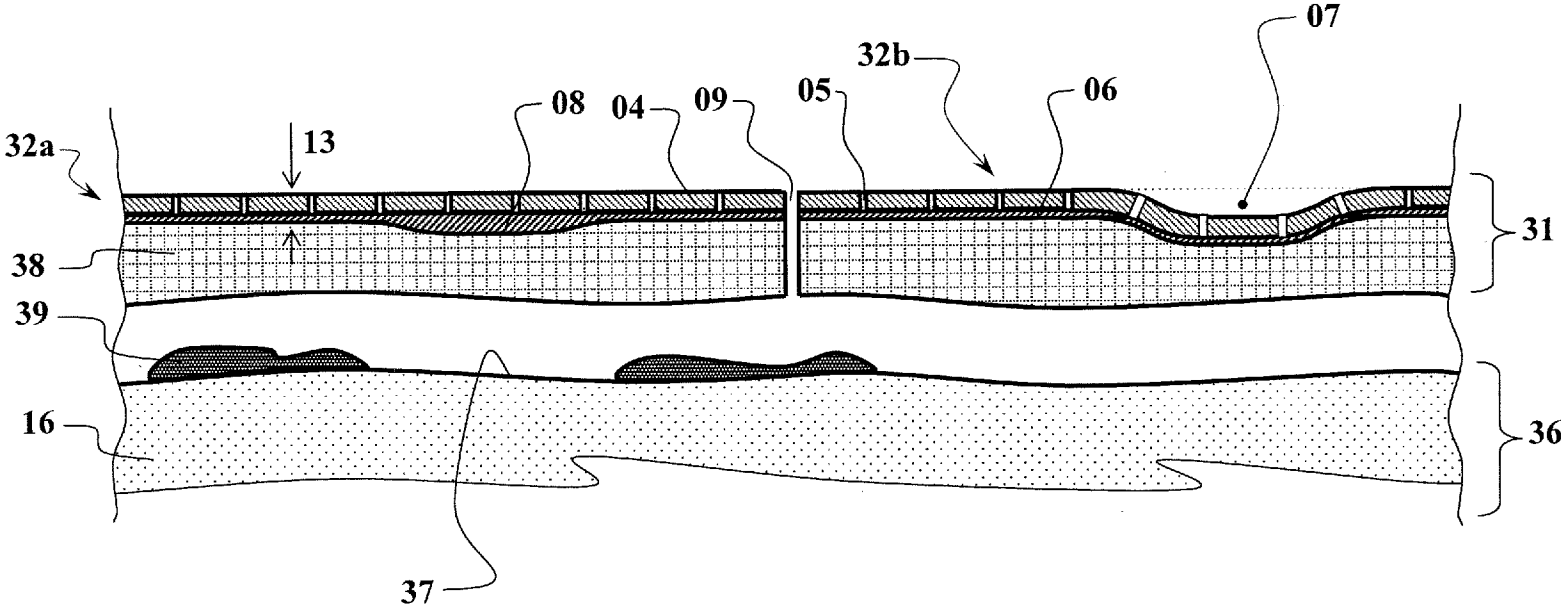

For implementation of one method according to the invention, FIG. 2 first of all shows the boat deck 36 at the bottom without any leveling layer and thus corresponds to the boat deck 16 of the previous view in FIG. 1. The upper face of the boat deck 36 has a bottom mounting surface 37. The prefabricated deck 31 can be mounted thereon by means of introduced glue 39.

Contrary to all known embodiments, however, this exemplary prefabricated deck 31 comprises such prefabricated deck elements 32*a* and 32*b* that have a leveling means 38 at the bottom face. The leveling means 38 mirrors the contour of the bottom mounting surface 37 with its bottom face. Thus, the prefabricated deck 31 can be glued to the boat deck 36 in a constant manner across the surface. Furthermore, the prefabricated deck 31 and the respective prefabricated deck elements 32 have a deck element 02 known from the previous design according to FIG. 1, which has a deck covering 04 that alternates with expansion joints 05 and a bottom-side support plate 06.

Figure 3:
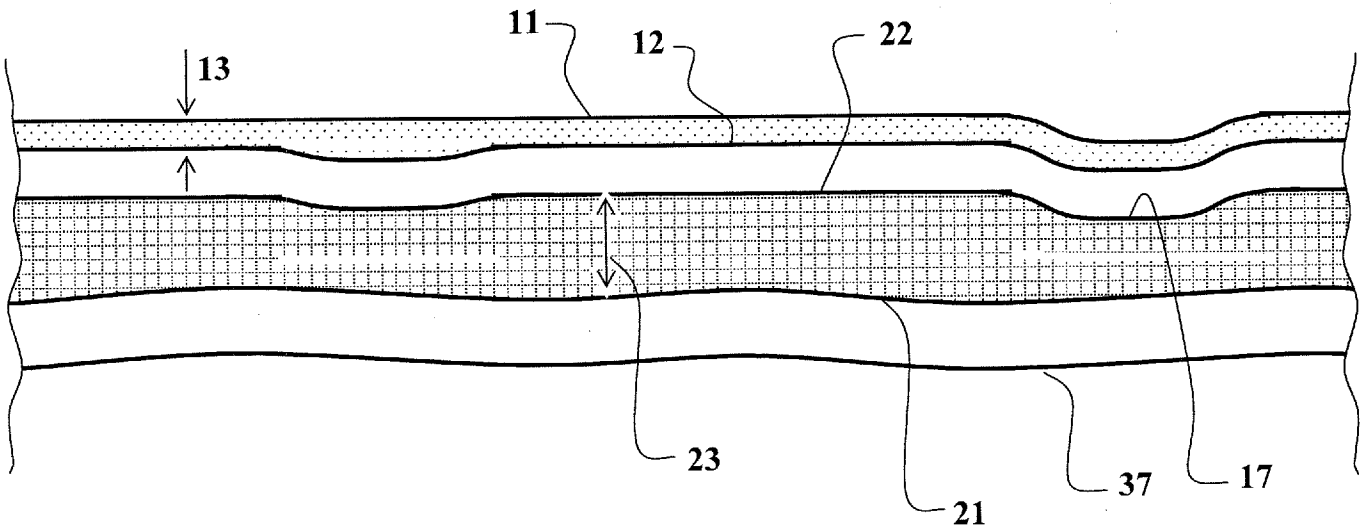
FIG. 3 shows a schematic sketch of the different height profiles and mutual distances.

With the aid of FIG. 3, the method according to the invention is to be exemplarily explained with reference to FIG. 1 and FIG. 2 without considering the adhesive layer.

At the top, the prefabricated deck having the target height profile 11 formed by the upper face is schematically outlined. The bottom face 12 of the deck element is located at a distance of the thickness 13 of the respective deck element. For illustration, the mounting height profile 22 is outlined at a distance underneath (in reality directly adjacent), having a corresponding contour. When realized, said mounting height profile 22 corresponds to the upper mounting surface 17, which is formed as the upper face of the applied leveling means 18 for gluing the prefabricated deck 01 (cf. FIG. 1). At the bottom, the lower mounting surface 37 (cf. FIG. 2) is illustrated, which represents the upper face of the boat deck 16 and 36, respectively, without the leveling means present. At a distance thereto (in reality directly adjacent), the actual height profile 21 is illustrated as being equivalent to the lower mounting surface 37. This means that the actual height profile 21 is formed by correspondingly measuring the upper face of the boat deck 16 and the lower mounting surface 37 as a basis for further calculation. The height difference 23 is calculated starting from the actual height profile 21 and the mounting height profile 22.

The produced leveling means 18 (cf. FIG. 1) and 38 (cf. FIG. 2) now embodies the height difference 23, which was calculated before, as a real component. The leveling means 38 is applied to the bottom face of the deck element (cf. FIG. 2), and together they form a prefabricated deck element that can be directly applied to the uneven boat deck. In the variant according to FIG. 1, the leveling means 18 is applied to the upper face of the boat deck 16, thus producing an upper mounting surface 17 to be covered by a regular prefabricated deck 01.

The invention claimed is:

1. A method for mounting a prefabricated deck on a boat deck, said prefabricated deck comprising at least one deck element, the method comprising the following steps:

setting a target height profile for an upper face of the prefabricated deck;

generating a mounting height profile spaced apart from the target height profile in a direction of the boat deck by a thickness of the deck element;

measuring the upper face of the boat deck as an actual height profile;

determining a height difference between the actual height profile and the mounting height profile;

producing a leveling means for the deck element, said leveling means having a material thickness that corresponds to the height difference; and mounting the leveling means and the deck element to the boat deck, the surface of the mounted prefabricated deck substantially corresponding to the target height profile.

2. The method according to claim 1, characterized by producing the leveling means with a material thickness that corresponds to the height difference independently of the deck element and subsequently applying the leveling means to a bottom face of the deck element and forming a prefabricated deck element.

3. The method according to claim 1, including applying the leveling means to a bottom face of the deck element and subsequently processing the leveling means to produce a material thickness that corresponds to the height difference.

4. The method according to claim 1, including setting a target height profile for the upper face of the prefabricated deck; and generating a mounting height profile that is spaced apart from the target height profile in the direction of the boat deck by the thickness of the prefabricated deck, the surface of the mounted prefabricated deck substantially corresponding to the target height profile.

5. The method according to claim 1, in which the target height profile is set based on a desired water drain.

6. The method according to claim 1, in which a minimum material thickness, which is at least zero upon application to the deck element and at least 5 mm upon application to the boat deck, is set for the leveling means, the mounting height profile being positioned at a smallest distance above the actual height profile corresponding to the minimum material thickness.

7. The method according to claim 5, in which if an inappropriate maximum material thickness and/or an inappropriately large distance between the actual height profile and the mounting height profile is determined in an edge portion of the prefabricated deck, the target height profile is reset in a different way with a different water drain.

8. The method according to claim 1, in which the leveling means is made of plastic and/or plant materials.

9. The method according to claim 1, in which a plate is machined on at least one side to produce the leveling means.

10. The method according to claim 1, in which a plurality of openings for venting are introduced into the leveling means prior to said leveling means being applied to the boat deck or to the deck element and/or a non-airtight plate is used for producing the leveling means.

11. A leveling means for use as an intermediate layer when mounting a prefabricated deck on a boat deck, the prefabricated deck comprising one or more deck elements, the bottom face of the deck element substantially defining a mounting height profile and the upper face of the boat deck substantially defining an actual height profile, said leveling means comprising;

a material thickness substantially corresponding to a height difference between the actual height profile and the mounting height profile, wherein prior to or after being applied to the boat deck, the leveling means is substantially produced with a material thickness that corresponds to the height difference.

12. A prefabricated deck comprising:

one or more prefabricated deck elements for covering a boat deck, the prefabricated deck element having a one-piece or multi-part deck covering visible and walkable on the boat deck after mounting; and a support plate lying directly or indirectly underneath, having substantially the size of the prefabricated deck element, the prefabricated deck element has a leveling means according to claim 11 at a bottom face.

13. The method according to claim 1, in which mounting the leveling means and the deck element to the boat deck includes gluing the leveling means and the deck element to the boat deck.

14. The method according to claim 1, in which applying the leveling means to the bottom face of the deck element includes gluing the leveling means to the bottom face of the deck element.

15. The method according to claim 1, in which the mounting height profile is spatially parallel to the target height profile.

16. The method according to claim 4, in which the mounting height profile is spatially parallel to the target height profile.

* * * * *